US006497380B2

(12) United States Patent
Kigawa et al.

(10) Patent No.: US 6,497,380 B2
(45) Date of Patent: Dec. 24, 2002

(54) DRUM WINDING APPARATUS

(75) Inventors: Hiroshi Kigawa, Tokyo (JP); Takashi Yumura, Tokyo (JP); Keigo Fukunaga, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 15 days.

(21) Appl. No.: 09/808,150

(22) Filed: Mar. 15, 2001

(65) Prior Publication Data

US 2001/0023905 A1 Sep. 27, 2001

(30) Foreign Application Priority Data

Mar. 24, 2000 (JP) ..... 2000-084045

(51) Int. Cl.[7] ..... B65H 75/48; B66B 11/06

(52) U.S. Cl. ..... 242/390.8; 242/390; 254/344; 254/362; 187/261

(58) Field of Search ..... 242/390, 390.8, 242/540, 564; 254/362, 344; 187/254, 261

(56) References Cited

FOREIGN PATENT DOCUMENTS

JP 63-160995 7/1988

*Primary Examiner*—John Q. Nguyen
(74) *Attorney, Agent, or Firm*—Leydig, Voit & Mayer, Ltd.

(57) ABSTRACT

In a drum winding unit, a cylindrical drum winding a wire is supported by paired supports fixed to a base structure so the drum freely rotates about a central axis of the drum. A drive unit for rotating the drum is disposed inside the drum. The drive unit is insertable into and extractable from the drum while keeping the drum and the supports in their operating positions.

17 Claims, 6 Drawing Sheets

DRUM WINDING APPARATUS

TITLE OF THE INVENTION

The present invention relates to a drum winding apparatus preferably for use with an elevator system for moving a lift unit or elevator cage upward and downward.

BACKGROUND OF THE INVENTION

Japanese Patent Application Laid-Open Publication No. 63-160995 describes a drum winding unit having a cylindrical drum in which a motor and a reducer are housed, for use in an elevator system to wind and unwind a wire that is connected at one end to a lift unit and at an opposite end to the drum. In this drum winding unit, for the purpose of maintenance and inspection of a drive unit disposed inside the drum, the drive unit should be extracted from and then inserted into the drum. In this instance, support members used to support the drum against a fixed structure must be removed to give access to the drive unit. Hence, particularly where there is little space around the drum winding unit, as is often experienced with a self-driven elevator system in which the drum winding apparatus is fixed to the lift unit, the extraction and insertion procedures are accompanied with considerable difficulty.

SUMMARY OF THE INVENTION

The present invention has been made to solve the above-described problems. To this end, a drum winding apparatus of the present invention has first and second supports. A cylindrical hollow drum having first and second ends is rotatably supported by the first and second supports, respectively. Also, the first end of the drum is defined with an opening. A bracket is fixed to the first support. A drive unit, which is inserted through the opening and housed in the drum, has a motor and an output shaft rotated by the motor. The drive unit is fixed to the bracket and the output shaft is detachably fixed to the second end of the drum so that a rotation of the output shaft is transmitted to the drum. In particular, the apparatus is designed so that the drive unit can be inserted and extracted through the opening of the drum while maintaining the drum in its operable position.

In another aspect of the present invention, the second end of the drum is supported by the second support through the output shaft and detachably fixed to the output shaft.

DETAILED DESCRIPTION OF THE PREFERRED EMBODIMENTS

First Embodiment

Figure 1:
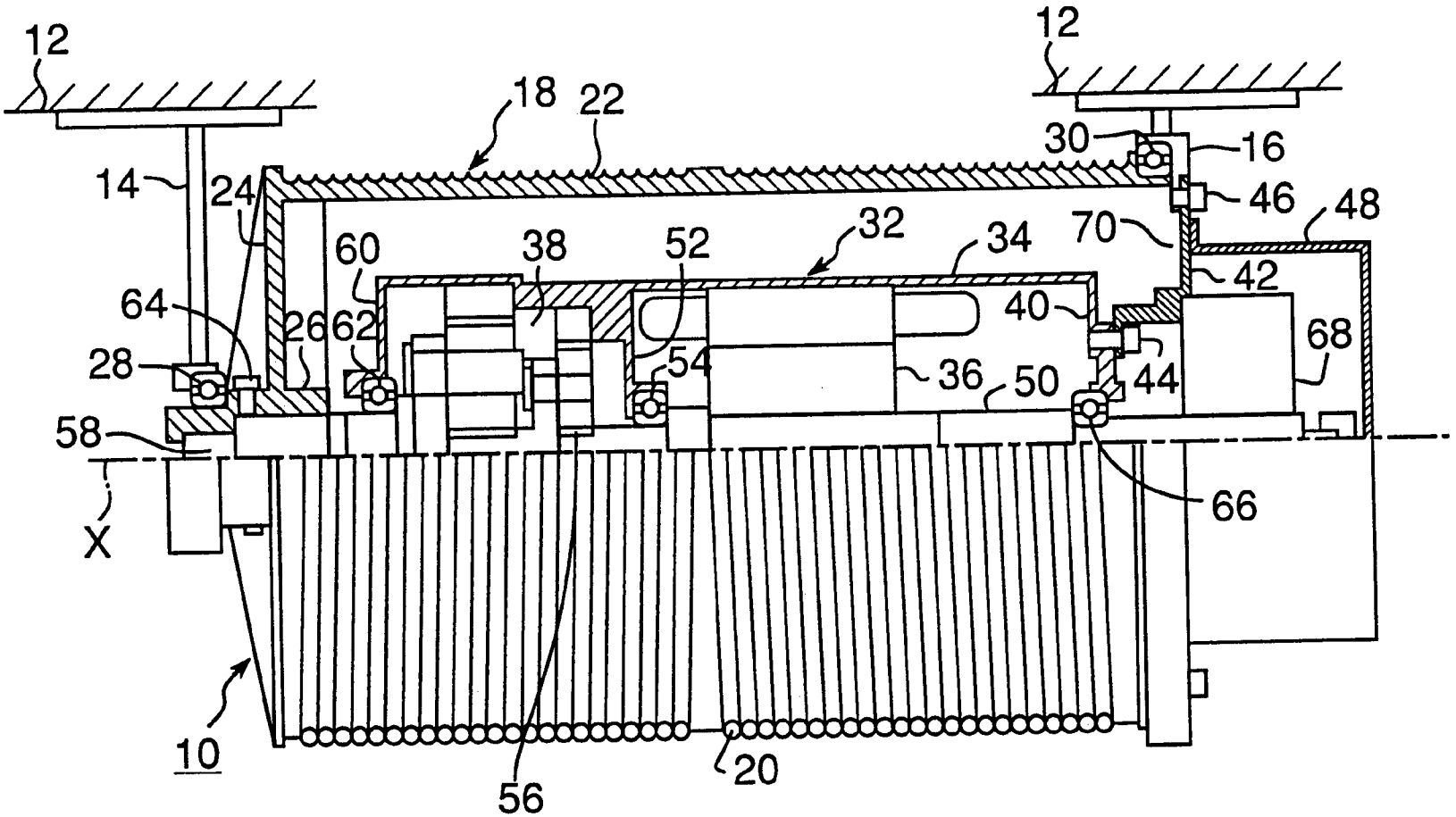
FIG. 1 is a cut-away side elevational view of the drum winding unit according to the first embodiment of the present invention.

FIG. 1 shows a drum winding unit for an elevator system according to a first preferred embodiment. The drum winding unit generally indicated by reference numeral 10 is supported by a base 12 through two supports 14 and 16 secured to a base structure 12. The base structure 12 may be a ceiling or bottom portion of a lift unit or elevator cage, a ceiling of an elevator hoistway or elevator shaft, or the lift unit itself.

The drum winding unit 10 has a hollow cylindrical drum 18. An outer peripheral surface portion of the drum 18 is formed with at least one spiral groove 22 so that a wire 20 is wound around the drum 18 at regular intervals. The drum includes a doughnut-like bracket 24 secured to one end (left-hand end in the drawing) of the drum 18. A support cylinder 26, which is positioned in a coaxial fashion with the drum 18 and inserted in a central opening of the doughnut-like bracket 24, is securely connected to the bracket 24. The cylinder 26 is supported for rotation at its one end (left-hand end in the drawing) through a bearing 28 positioned between the cylinder 26 and the support 14. The other end (right-hand end in the drawing) of the drum 18 is supported for rotation by the support 16 through a bearing 30 positioned between the drum 18 and the support 16. This arrangement allows the drum 18 to rotate about its longitudinal axis X and thereby to wind and rewind the wire 20 therearound.

A drive unit 32, which is accommodated inside the drum 18, has a hollow cylindrical casing 34 preferably mounted in a coaxial fashion with the drum 18. The casing 34 includes a motor 36 and a reducer 38 fixed in the casing 34. One end (right-hand end in the drawing) of the cylindrical casing 34, located adjacent the drive unit 36, supports a doughnut-like bracket 40. The bracket 40 is connected by bolts 44 to another external doughnut-like bracket 42 located adjacent to the bracket 40. The bracket 42 is in turn connected by bolts 46 to the support 16. A protection cover 48 is detachably mounted to an outer surface of the bracket 42.

The motor 36 has a rotation shaft 50 rotated by the motor 36. One end (left-hand end in the drawing) of the rotation shaft 50 is supported between the motor 36 and the reducer 38 by a bearing 54. The bearing 54 is supported by at an inner peripheral portion of a doughnut-like partition wall 52 that extends radially inwardly from an inner peripheral surface of the casing 34, and it is drivingly connected to the reducer 38 through a gear 56. An output shaft 58 of the reducer 38 is extended out through a central opening of a doughnut-like bracket 60 fixed to the other end (left-hand end in the drawing) of the casing 34, and it is supported for rotation by a bearing 62 provided in the opening. Also, a protruded portion of the output shaft 58 is then inserted into and secured by a pin or bolt 64 to the support cylinder 26 fixed to the drum 18.

The other end (right-hand end in the drawing) of the rotation shaft 50 is extended out through a central opening of the doughnut-like bracket 40 and then supported for rotation by a bearing 66 mounted in the opening. A protruded portion of the rotation shaft 50 terminates in a chamber defined by the protection cover 48 and the bracket 42, where it is drivingly connected to a brake mechanism 68.

In the drum winding unit 10 so constructed, the motor 36 drives to rotate the rotation shaft 50. The rotation of the shaft 50 is transmitted through the gear 56 to the reducer 38 where it is reduced. The reduced rotation of the output shaft 58 is then transmitted through the bolt 64 to the drum 18, the support-cylinder 26 and the bracket 24, so that the drum 18 rotates about its longitudinal axis X, winding or rewinding the wire 20.

For maintenance and inspection of the motor 36, the reducer 38 and another parts of the drive unit 32, the bolt 64 connecting between the output shaft 58 and the support cylinder 26 is removed. Also, the bolts 46 connecting between the bracket 42 and the support 16 are removed. This allows the bracket 42 together with the drive unit 32 to be separated from the drum 18.

The separation of the bracket 42 from the support 16 reveals an end opening 70 of the drum 18 that has been closed by the bracket 42. The opening 70 is designed to be larger than the corresponding portions of the drive unit 32. This in turn implies that each portion of the drive unit 32 is designed to be smaller than the opening 70. Also, the drive unit 32 and support 16 are designed so that the supports 16 gives way to the drive unit 32 during the extraction and insertion of the drive unit 32. As a result, the drive unit 32 is extracted through the opening 70 of the drum 18 as the drum 18 is supported by the supports 14 and 16. The extracted drive unit 32 is then moved to a place where the maintenance and inspection can be done freely. After maintenance and inspection of the drive unit 32, it is returned and fixed in the drum 18 by the reverse procedures required for its extraction. At this moment, due to the above-described designs of the drive unit 32, the opening 70, and the support 16, the drive unit 32 makes no interference with the support 16.

As described above, the drum winding unit according to the first embodiment permits to perform maintenance and inspection of the drive unit 32 while keeping the supports 14, 16 and the drum 18 as they are during operation. In addition, a maintenance and inspection requires only a small space for the extracted drive unit 32, which in turn minimizes the space for the maintenance and inspection of the drive unit.

Second Embodiment

Figure 2:
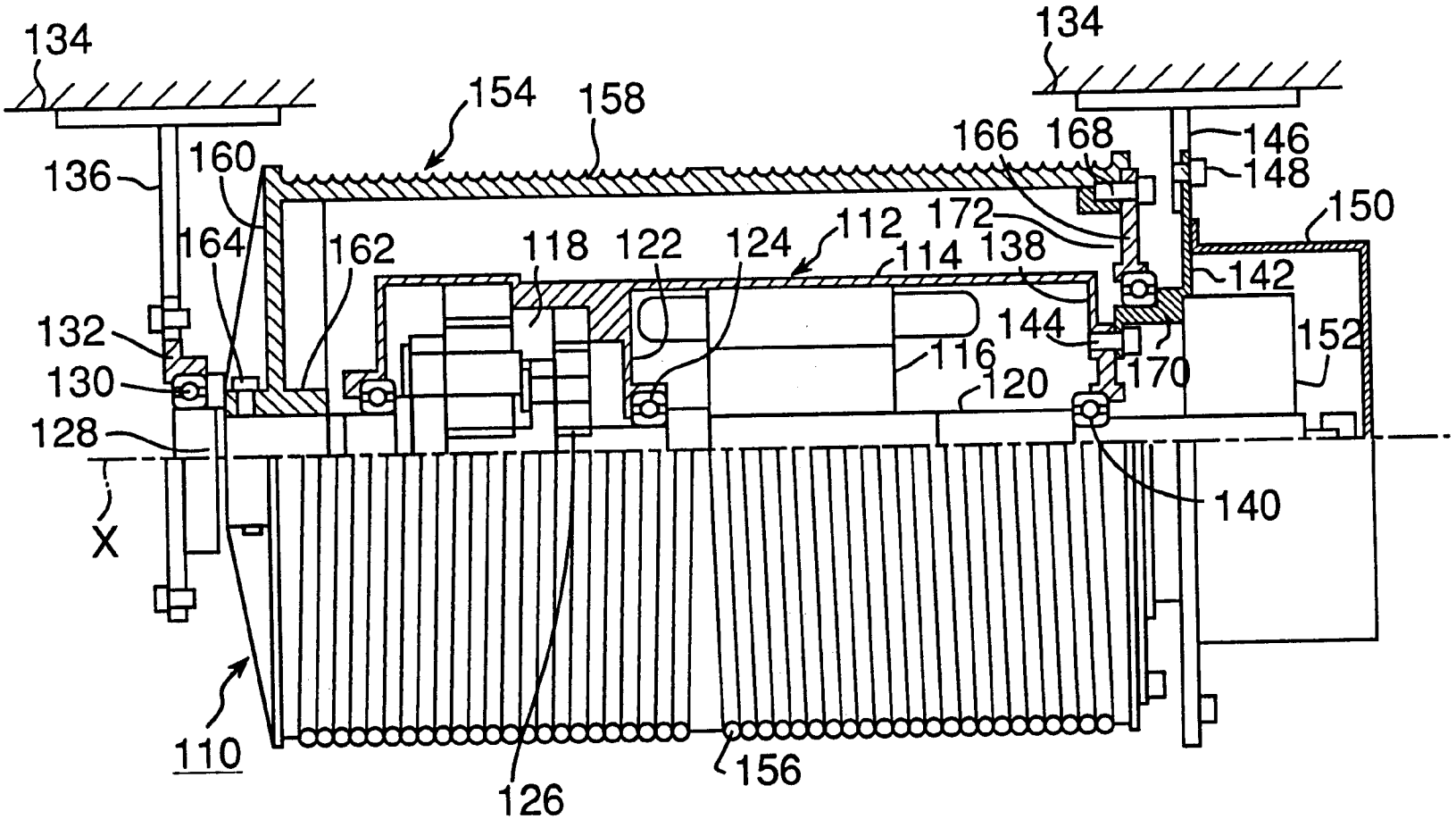
FIG. 2 is a cut-away side elevational view of the drum winding unit according to the second embodiment of the present invention.

FIG. 2 shows a drum winding unit for an elevator system according to a second preferred embodiment. In this drum winding unit 110, a drive portion 112 includes, in a cylindrical casing 114, a motor 116 and a reducer 118. The motor 116 has a rotation shaft 120 rotated by the motor 116. One end (left-hand end in the drawing) of the rotation shaft 120 is supported between the motor 116 and the reducer 118 by a disk-like partition wall 122 through a bearing 124. The disk-like partition wall 122 extends radially and inwardly from an inner peripheral surface of the casing 114. Also, the one end of the rotation shaft 120 holds a gear 126 drivingly connected to the reducer 118. Meanwhile, an output shaft 128 of the reducer 118 is supported through a bearing 130 and then a disk-like bracket 132 holding the bearing 130 by a support 136 secured to a fixed base structure 134. The base structure 134 may be a ceiling or bottom portion of a lift unit or elevator cage, a ceiling portion of an elevator hoistway or elevator shaft, or the lift unit itself.

The other end (right-hand end in the drawing) of the rotation shaft 120 is extended out through a bearing 140 mounted on a bracket 138. The bracket 138 is positioned and fixed at an opening of the opposite end (right-hand end in the drawing) of the casing 114. Also, the bracket 138 is connected by bolts 144 to a disk-like bracket 142 disposed outside the bracket 138. The bracket 142 is in turn connected by bolts 148 to a support 146 fixed to the base structure 134. A protection cover 150 is mounted on the outer surface of the bracket 142 so that the cover 150 and the bracket 142 defined a chamber in which a braking mechanism 152 is housed and drivingly connected to the rotation shaft 120.

An outer peripheral portion of the drum 154 is provided with at least one spiral wire groove 158 along which a wire 156 is wound around the drum 154. A disk-like bracket 160 is fixed to one end (left-hand end in the drawing) of the drum 154. In addition, a support cylinder 162, which is positioned and fixed in a central opening of the bracket 160, is supported by and fixed to the output shaft 128 of the reducer 118. Another disk-like bracket 166 is fixed bolts 168 to the opposite end (right-hand end in the drawing) of the drum 154. Further, the bracket 166 is supported for rotation about the rotational axis X through a bearing 170 by another bracket 142.

In the drum winding unit 110 so constructed, the motor 116 drives to rotate its rotation shaft 120. The rotation of the shaft 120 is transmitted to the reducer 118 where it is reduced to the predetermined number of revolutions. The reduced rotation of the output shaft 128 of the reducer 118 is then transmitted through the bolt 164, the support cylinder 162 and the bracket 160 fixed to the output axis 128 to the drum 154. This causes the drum 154 to rotate in the bearings 130 and 170, winding and rewinding the wire 156.

For maintenance and inspection of the components of the drive unit 112, such as motor 116 and the reducer 118, a suitable support is prepared to hold the drum 154 at the operational position shown in the drawing. Next, the bolt 164 is removed. Also, removed are the bolts 168 connecting between the drum 154 and the bracket 166 and the bolts 148 connecting between the bracket 142 and the support 146. Then, the drive portion 112 is extracted through the opening 172 of the drum 154. At this stage, the output axis 128 is removed from the bearing 130, which can be performed without any difficulty using a dedicated tool not shown. To extract the drive unit 112 from the drum 154 without any need to detach the support 146 from the base structure 134, the bracket 166 and the casing 114 are configured and sized so that neither of the bracket 166 nor the casing 114 would interfere with the support 146 at the extraction of the drive unit 112. The drive unit 112 extracted from the drum 154 is placed in an appropriate position where maintenance and inspection procedures are performed. Further, after maintenance and inspection, the drive unit 112 is returned into the drum 154 by the procedures required for its extraction and then fixed to the drum 154.

As described above, the drum winding unit according to the second embodiment permits to perform maintenance and inspection of the drive portion 112 while keeping the supports 136, 146 and the drum 154 as they are during operation. In addition, the maintenance and inspection requires only a space for placing the extracted drive unit 112, which minimizes the space for the maintenance and inspection of the drive unit.

Third Embodiment

Figure 3:
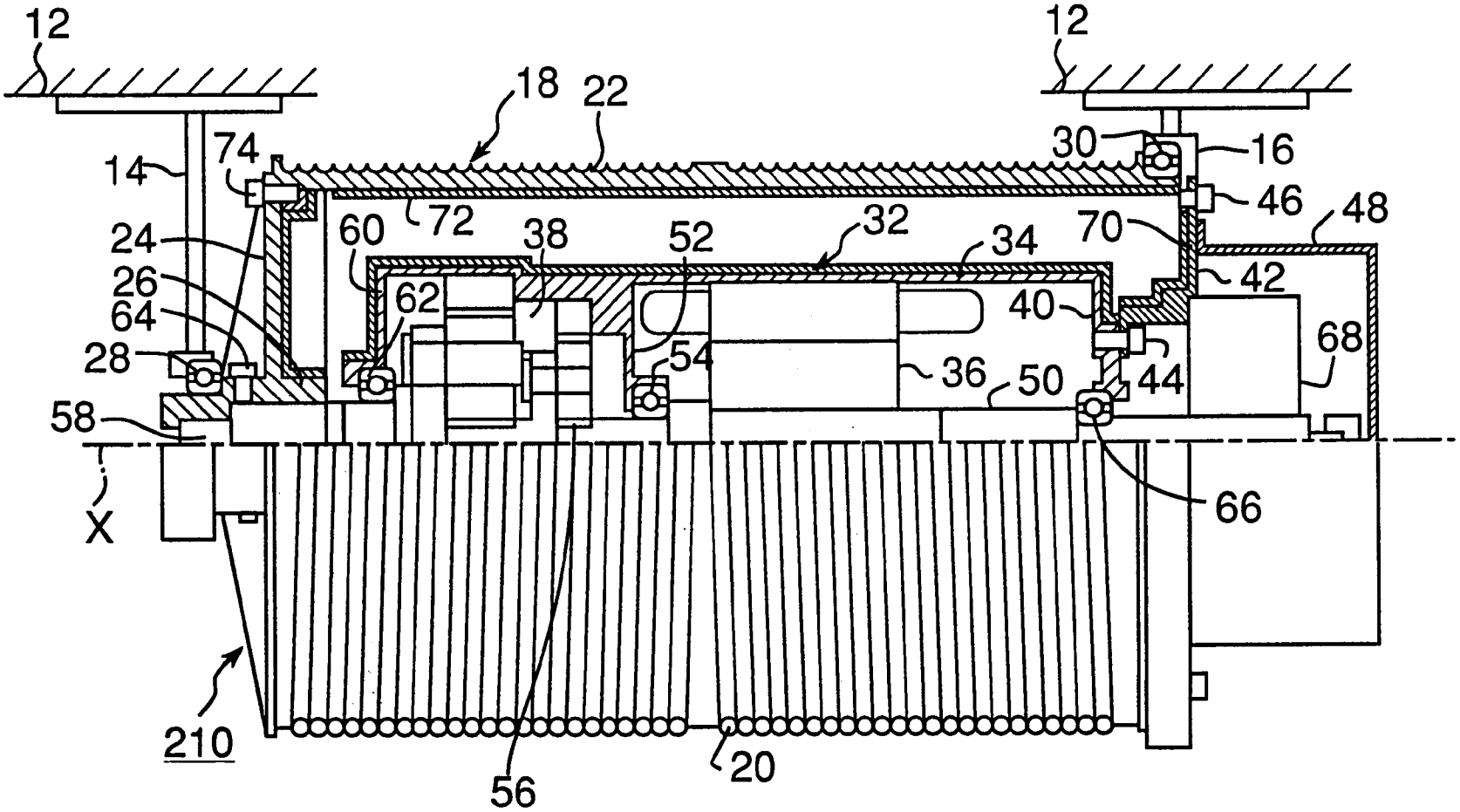
FIG. 3 is a cut-away side elevational view of the drum winding unit according to the third embodiment of the present invention.

FIG. 3 shows a drum winding unit for an elevator system according to a third embodiment of the present invention. The drum winding unit generally indicated by reference numeral 210 is a modification of the drum winding unit 10 shown in FIG. 1 and includes several improvements provided to the drum winding unit 10. Specifically, in order to minimize noises that would be generated at the motor 36 of the drive unit 32 and then leak to the atmosphere, the drum winding unit 210 of this embodiment has a sound absorbing member 72 disposed on the inner surface portions of the drum 18, the outer surface portions of the casing 34 and the inner surface portions of the brackets 24 and 42. Examples of the material of the sound absorbing member 72 are urethane foam and glass wool. However, another absorbing material known to the art may be used instead.

With the drum winding unit 210 equipped with the sound absorbing member 72, even when the unit is mounted on the elevating unit of the elevator system, the noise possibly occurred at the drive unit 32 and then transmitted to the elevating unit such as elevator cage is minimized, which in turn minimizes a discomfort of the passengers in the elevating unit.

It should be noted that the sound absorbing member 72 may be provided on the whole or a part of the entire portions of the internal surface of the drum 18, the external surface of the casing 34 and the internal surfaces of the brackets 24 and 42. Even in the latter instance, the noises leaking to the atmosphere can be reduced to a certain extent.

Further, as shown in FIG. 3, it is desirable that the bracket 24 away from the extraction opening of the drum 18 is detachably secured to the drum by bolts 74. This allows the sound absorbing member 72 to be mounted on the inner surface of the bracket 24 and its vicinity and also to be repaired when it is damages, without any difficulty.

Figure 4B:
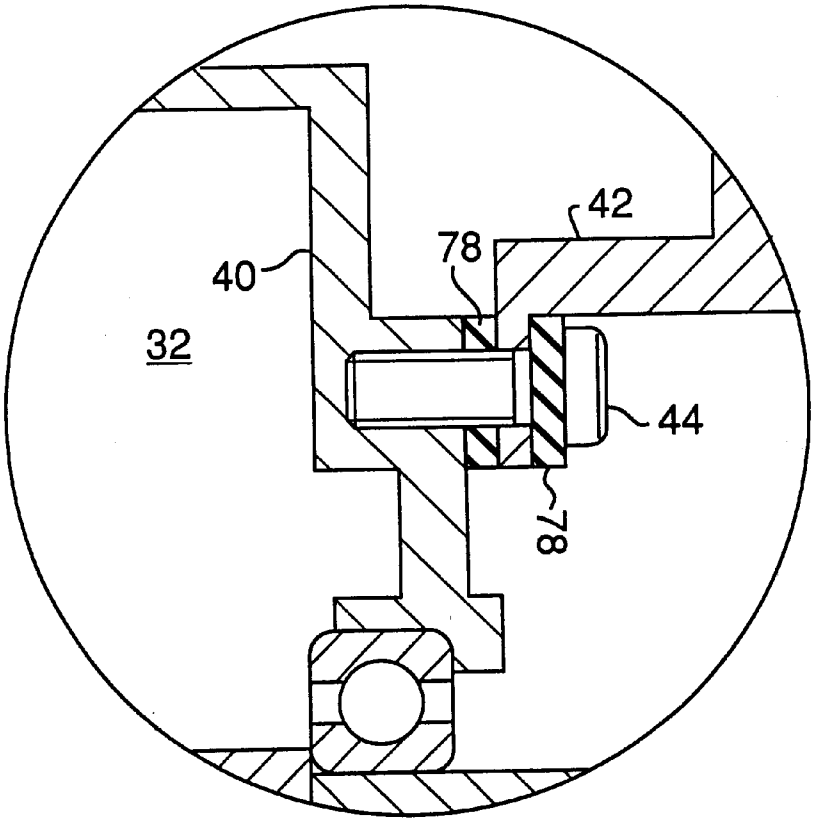
FIGS. 4A and 4B are enlarged cross sectional views showing respective connecting portions between the drum and the drive unit.
Figure 4A:
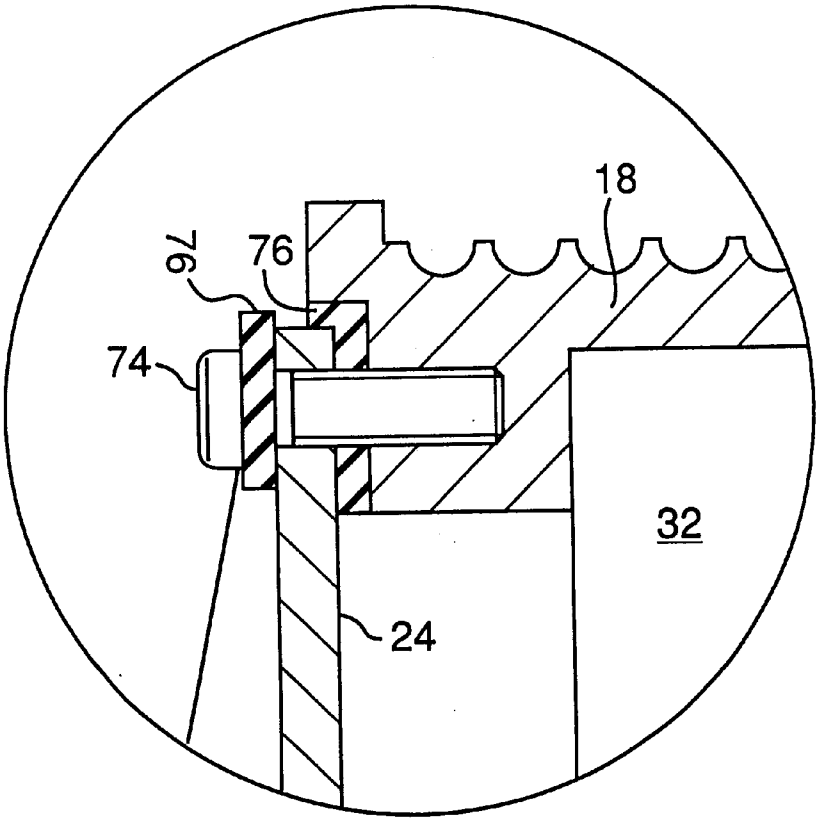

Still further, as shown in FIGS. 4A and 4B, elastic members 76 and 78 may be disposed a portion between the drum 18 and the bracket 24 and between the bolt 74 and the bracket 24, and another portion between the bracket 40 of the drive unit 32 and another bracket 42 supporting the bracket 40 and between the bolt 44 and the bracket 42, respectively. This reduces a transmission of vibrations generated at the motor 36 or the reducer 38 to the drum 18, the supports 14 and 16, and even further to the elevator cage for passengers, and hence, to provide a pleasant ride to the passengers. Any vibration-proof material may be used for the elastic members 76 and 78, including rubber, urethane and metal springs.

Fourth Embodiment

Figure 5:
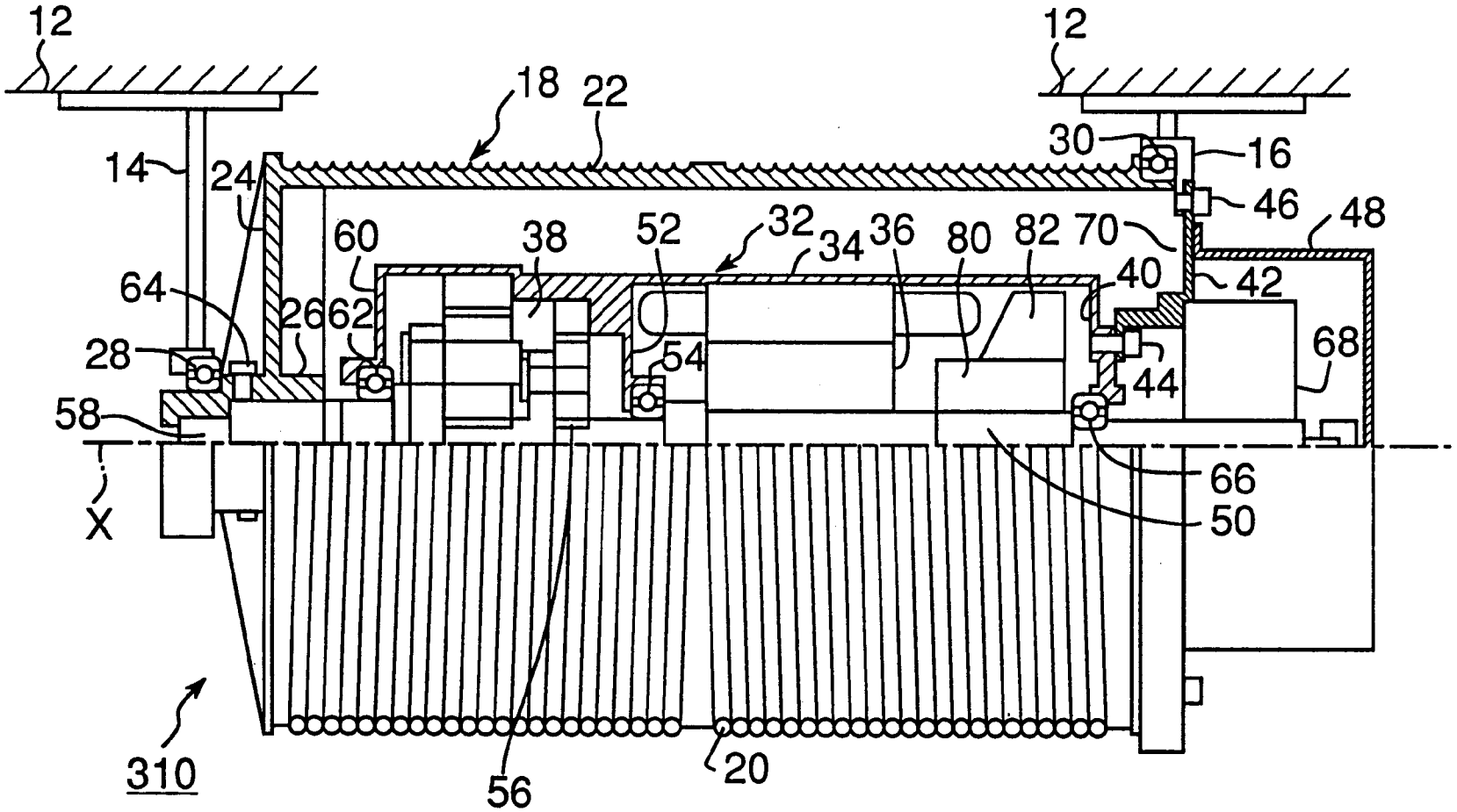
FIG. 5 is a cut-away side elevational view of the drum winding unit according to the fourth embodiment of the present invention.

FIG. 5 shows another drum winding unit for an elevator system according to a fourth embodiment. The drum winding unit generally indicated by reference numeral 310 is a modification of the drum winding unit 10 shown in FIG. 1. Specifically, in the drum winding unit 310 a weight made of a flywheel 80 having a predetermined weight is mounted on the rotation shaft 50 of the motor 36. The flywheel 80 is used to increase the weight of the rotation axis 50, and hence, an inertial force generated at the braking operation. In particular, the flywheel 80 is effective to a drum winding unit in which the drive unit 32 is installed in the drum 18. In detail, the small-sized drive unit 36 suffers less inertial force of rotation at its rotation shaft 50, which results in an rapid deceleration of the shaft 50 by the braking operation, providing a significant deceleration shock to the elevating unit or cage. Yet, the flywheel with a certain weight provides an additional inertial force of rotation to the rotation shaft at deceleration, which prevents the rapid deceleration of the elevating unit and also possible damages to the elevating unit as well as passengers in the elevating unit.

Further, the rotation shaft 50 and/or the flywheel 80 may be provided with a fan 82 fixed thereto. This allows heat generated at the motor 36 of the drive unit 32 to be mixed with an ambient air in the casing 34, which prevents the heated air from being maintained at certain places.

Fifth Embodiment

Figure 6:
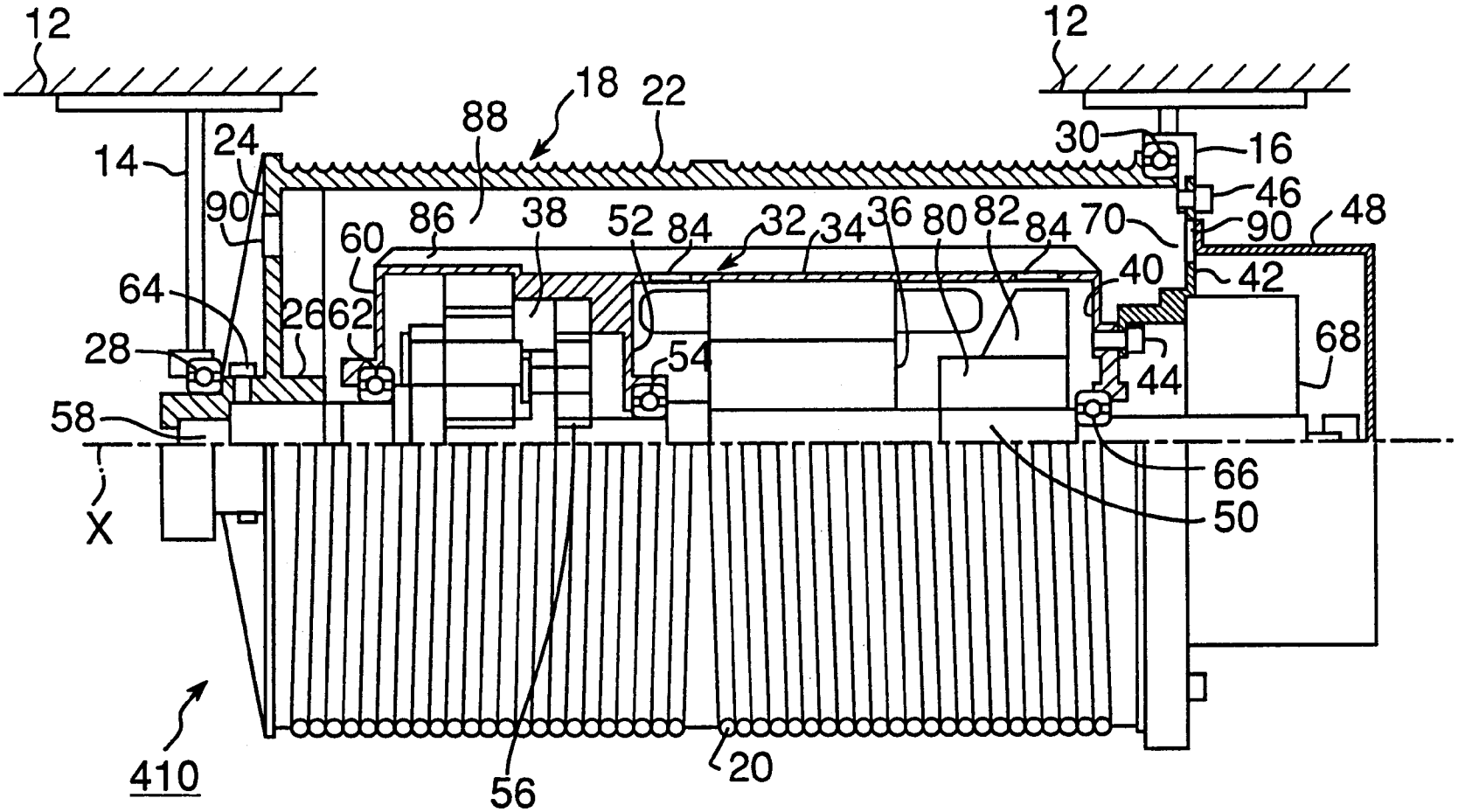
FIG. 6 is a cut-away side elevational view of the drum winding unit according to the fifth embodiment of the present invention.

FIG. 6 shows another drum winding unit for an elevator system according to a fifth embodiment. The drum winding unit generally indicated by reference numeral 410 is a modification of the drum winding unit 10 shown in FIG. 1 and differs therefrom in the followings.

Specifically, in the drum winding unit 410, a plurality of apertures or vent holes 84 are formed in the casing 34 of the drive unit 32. In addition, one or more radiators in the form of fins 86 are provided on the outer peripheral surface of the casing 34 of the drive unit 32. With the arrangement, heat generated at the drive unit 32 is effectively discharged through the vent holes 84 into a chamber 88 or space defined between the drum 18 and the drive unit 32. Simultaneously with this, the heat is transmitted to the casing 34 and also the radiator fins 86 and then radiated into the chamber 88. A this moment, the heat in the chamber 88 is dissipated by the drum 18 rotating around the chamber 88, which prevents a specific portion to be overheated.

In addition, as shown in FIG. 6, the brackets 24 and 42 supporting the drum 18 may be formed with one or more apertures or vent holes 90 so that heat in the chamber 88 is discharged therethrough into the atmosphere, which improves the heat radiation from the drum 18.

As described above, the present invention includes a number of advantages over the conventional drum winding unit. For example, the drive unit can be inserted into and extracted from the drum for the maintenance and inspection procedures of the drive unit while keeping the supports and the drum as they are during operation. In addition, since the maintenance and inspection requires only a small space for placing the extracted drive unit. This minimizes the space for maintenance and inspection.

Also, the sound absorbing member absorbs noises at the drive unit. This reduces unpleasant noises to the passengers in the lift unit even when the drum winding unit is installed to the lift unit.

The elastic members positioned between the bracket and the drum and between the drive unit and the bracket reduce a transmission of vibrations generated at the motor or the reducer to the drum, the supports and even further to the lift unit accepting passengers, and hence, to provide a pleasant ride to the passengers.

The weight such as flywheel fixed to the rotation shaft of the motor increases the inertial moment or force of the shaft. This avoids the drastic deceleration, and as a result, a jolt upon a lift unit and passengers is reduced.

The fan fixed to the rotation axis of the motor dissipates heat developed at the motor of the drive unit, preventing a local heating of the drive unit.

The vent hole formed in the casing of the drive unit allows heat developed at the drive portion to be discharged through the vent hole into the space between the drum and the drive portion, preventing a local heating of the drive unit. The local heating is further reduced with another vent holes formed in the bracket that supports the end portion of the drum and also with radiators or fin mounted to the casing of the drive portion.

What is claimed is:

1. A drum winding apparatus comprising:

first and second supports fixed to a base structure;

a cylindrical drum having first and second ends and supported for rotation by the first and second supports, respectively, for winding and unwinding a wire therearound, the first end of the drum having an opening; and a drive unit mounted in the drum for rotating the drum, wherein the drum, the drive unit, and the first and second supports are configured so that the drive unit can be inserted and extracted through the opening of the drum while maintaining the drum in its operating position.

2. The drum winding apparatus in accordance with claim 1, further comprising first and second bearings located between the drum and the first and second supports, respectively, so that the drum is supported for rotation through the first and second bearings by the first and second supports, respectively, wherein the opening of the drum is within the first bearing and sized so that the drive unit can be inserted into and extracted from the drum, the drive unit in the drum is detachably fixed to the first support, and the drive unit has a housing, a motor fixed in the housing, and an output shaft rotated by the motor and detachably fixed to the second end of the drum.

3. The drum winding apparatus in accordance with claim 2, wherein at least a part of both an inner surface of the drum and an outer surface of the housing is covered by a sound absorbing member.

4. The drum winding apparatus in accordance with claim 2, including a rotation shaft carrying a weight adding inertia to the output shaft.

5. The drum winding apparatus in accordance with claim 2, including a rotation shaft carrying a fan rotating with the output shaft.

6. The drum winding apparatus in accordance with claim 2, wherein the housing has at least one vent hole.

7. The drum winding apparatus in accordance with claim 2, wherein the housing includes a radiator.

8. The drum winding apparatus in accordance with claim 2, wherein the second end of the drum is supported by the second support through the output shaft and is detachably fixed to the output shaft.

9. The drum winding apparatus in accordance with claim 1, wherein the drum has a bracket detachably connected to one of the first and second ends of the drum through an elastic material located between the drum and the bracket.

10. The drum winding apparatus in accordance with claim 9, wherein the bracket includes at least one vent hole.

11. The drum winding apparatus in accordance with claim 1, wherein the opening of the drum is sized so that the drive unit can be inserted into and extracted from the drum, the drive unit has a housing detachably fixed to the first support, a motor fixed to the housing, and an output shaft rotated by the motor and supported for rotation by the second support; and the drum is detachably fixed to the output shaft and supported for rotation by the housing of the drive unit.

12. A drum winding apparatus in accordance with claim 11, further comprising:

first and second brackets detachably connected to the housing; and first and second bearings for supporting the first and second brackets on the output shaft so that the output shaft rotates relative to the first and second brackets.

13. The drum winding apparatus in accordance with claim 11, wherein the second end of the drum is supported for rotation by the second support and the output shaft is detachably fixed to the second end of the drum.

14. The drum winding apparatus in accordance with claim 1, wherein the drum has a bracket detachably connected to the housing of the drive unit through an elastic material located between the housing and the bracket.

15. An elevator system comprising:

a drum winding unit having:

a base structure;

first and second supports fixed to the base structure;

a cylindrical drum having an open first end and a closed second end, the first and second ends being respectively supported by the first and second supports so that the drum rotates about a longitudinal axis of the drum to wind and unwind a wire about an outer periphery of the drum;

a bracket detachably fixed to the first support and positioned at the open first end of the drum; and a drive unit having a motor and an output shaft rotated by the motor, the drive unit being housed in the drum and fixed to the bracket, the output shaft being positioned on the longitudinal axis and detachably connected to the second end of the drum, wherein the drive unit may be inserted and extracted through the open first end of the drum while maintaining the drum in its operating position.

16. A drum winding apparatus comprising:

first and second supports;

a cylindrical hollow drum having first and second ends rotatably supported by the first and second supports, respectively, the first end having an opening;

a bracket fixed to said first support; and a drive unit insertable through the opening and housed in the drum, the drive unit having a motor and an output shaft rotated by the motor, the drive unit being fixed to the bracket and the output shaft being detachably fixed to the second end of the drum so that rotation of the output shaft is transmitted to the drum, wherein the drive unit may be inserted and extracted through the opening of the drum while maintaining the drum in its operating position.

17. The drum winding apparatus in accordance with claim 16, wherein the second end of the drum is supported by the second support through the output shaft and is detachably fixed to the output shaft.

* * * * *